US008396382B2

(12) United States Patent
Mori et al.

(10) Patent No.: US 8,396,382 B2
(45) Date of Patent: Mar. 12, 2013

(54) IMAGE FORMING APPARATUS INCLUDING A BLOWER MEMBER AND A HEATING DEVICE

(75) Inventors: Masahiro Mori, Kanagawa (JP); Yutaka Nakayama, Kanagawa (JP); Akio Fukuyama, Kanagawa (JP); Yousuke Hasegawa, Kanagawa (JP); Takeshi Yoneyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 278 days.

(21) Appl. No.: 12/905,768

(22) Filed: Oct. 15, 2010

(65) Prior Publication Data

US 2011/0229166 A1 Sep. 22, 2011

(30) Foreign Application Priority Data

Mar. 17, 2010 (JP) ..... 2010-061189

(51) Int. Cl.
*G03G 15/00* (2006.01)
*G03G 21/20* (2006.01)

(52) U.S. Cl. ..... 399/43; 399/92; 399/401; 399/405

(58) Field of Classification Search ..... 399/322, 399/323, 43, 92, 401, 405, 406
See application file for complete search history.

(56) References Cited

U.S. PATENT DOCUMENTS

| | | | | |
|---|---|---|---|---|
| 7,433,625 | B2 * | 10/2008 | Yamaoka et al. | 399/92 |
| 7,466,934 | B2 * | 12/2008 | Chae et al. | 399/92 |
| 8,139,974 | B2 * | 3/2012 | Sakuwa | 399/92 |
| 2007/0059024 | A1 * | 3/2007 | Kitayama | 399/92 |
| 2008/0044213 | A1 * | 2/2008 | Kato et al. | 399/405 |
| 2010/0329726 | A1 * | 12/2010 | Kasuga | 399/92 |

FOREIGN PATENT DOCUMENTS

| | | | |
|---|---|---|---|
| JP | 05119669 | A * | 5/1993 |
| JP | 2003015464 | A * | 1/2003 |
| JP | 2006133279 | A * | 5/2006 |
| JP | 2008-134484 | A | 6/2008 |

* cited by examiner

*Primary Examiner* — Susan Lee
(74) *Attorney, Agent, or Firm* — Sughrue Mion, PLLC

(57) ABSTRACT

An image forming apparatus includes: a heating device that heats images that have been formed on a sheet-like recording medium to thereby fix the images to the recording medium; an ejection member that rotates in a forward direction and ejects to the outside the recording medium that has been conveyed from the heating device; a blower member that blows air onto the recording medium conveyed between the heating device and the ejection member; and a controller that controls the blower member such that the blower member operates when a recording page count where images are continuously formed on the recording medium is equal to or greater than a predetermined recording page count.

6 Claims, 6 Drawing Sheets

IMAGE FORMING APPARATUS INCLUDING A BLOWER MEMBER AND A HEATING DEVICE

CROSS-REFERENCE TO RELATED APPLICATION

This application is based on and claims priority under 35 USC 119 from Japanese Patent Application No. 2010-061189 filed on Mar. 17, 2010.

BACKGROUND

Technical Field

The present invention relates to an image forming apparatus.

SUMMARY

An image forming apparatus pertaining to a first aspect of the invention includes: a heating device (fixing device) that heats images that have been formed on a sheet-like recording medium to thereby fix the images to the recording medium; an ejection member that rotates in a forward direction and ejects to the outside the recording medium that has been conveyed from the heating device; a blower member that blows air onto the recording medium conveyed between the heating device and the ejection member; and a controller that controls the blower member such that the blower member operates when a recording page count where images are continuously formed on the recording medium is equal to or greater than a predetermined recording page count.

BRIEF DESCRIPTION OF THE DRAWINGS

Exemplary embodiments of the present invention will be described in detail based on the following figures, wherein.

DETAILED DESCRIPTION

Figure 1:
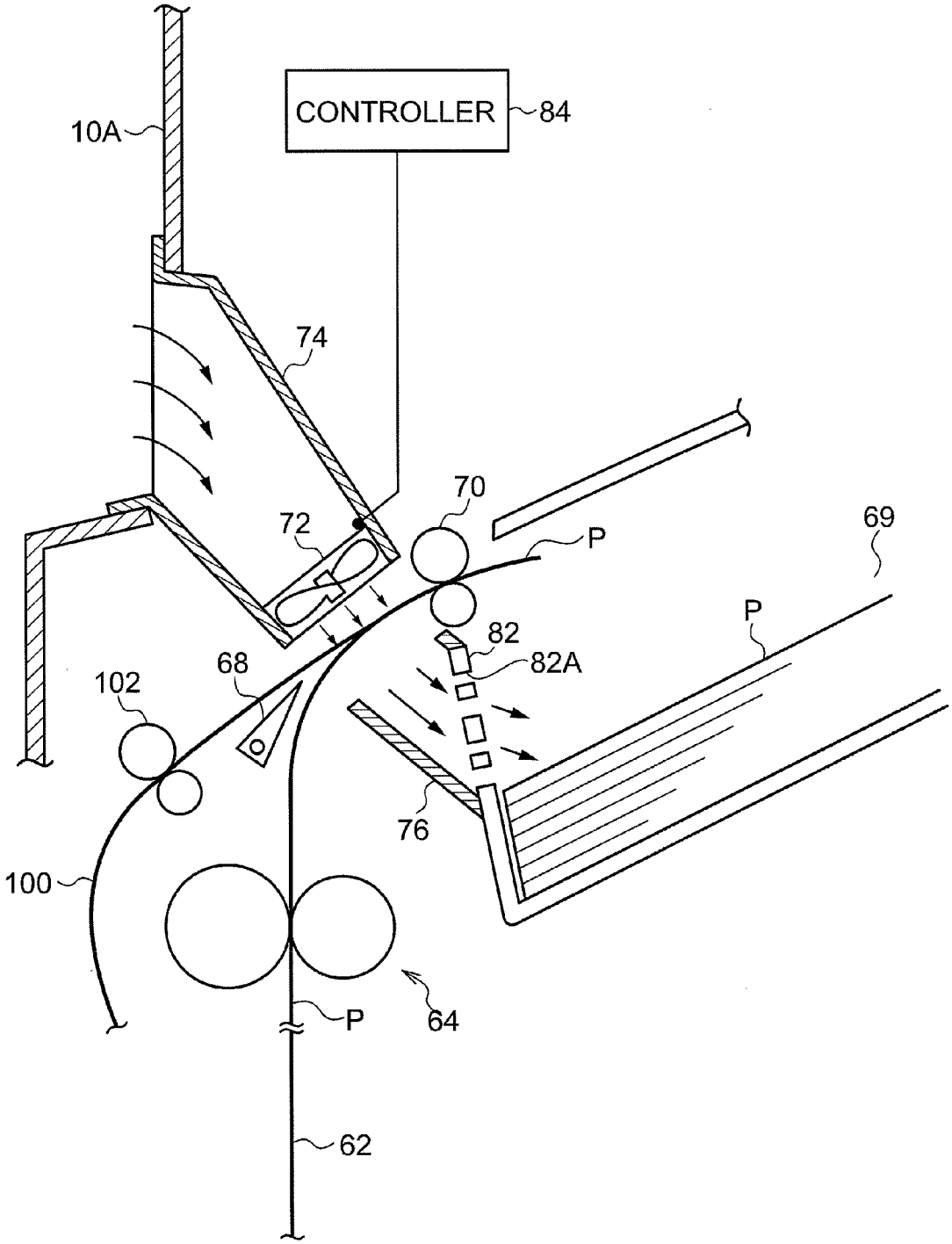
FIG. 1 is a side view showing a blower fan and the like employed in an image forming apparatus pertaining to a first exemplary embodiment of the present invention.

An image forming apparatus 10 pertaining to a first exemplary embodiment of the present invention will be described in accordance with FIG. 1 to FIG. 5. Arrow UP in the drawings represents up in the vertical direction.

(Overall Configuration)

Figure 5:
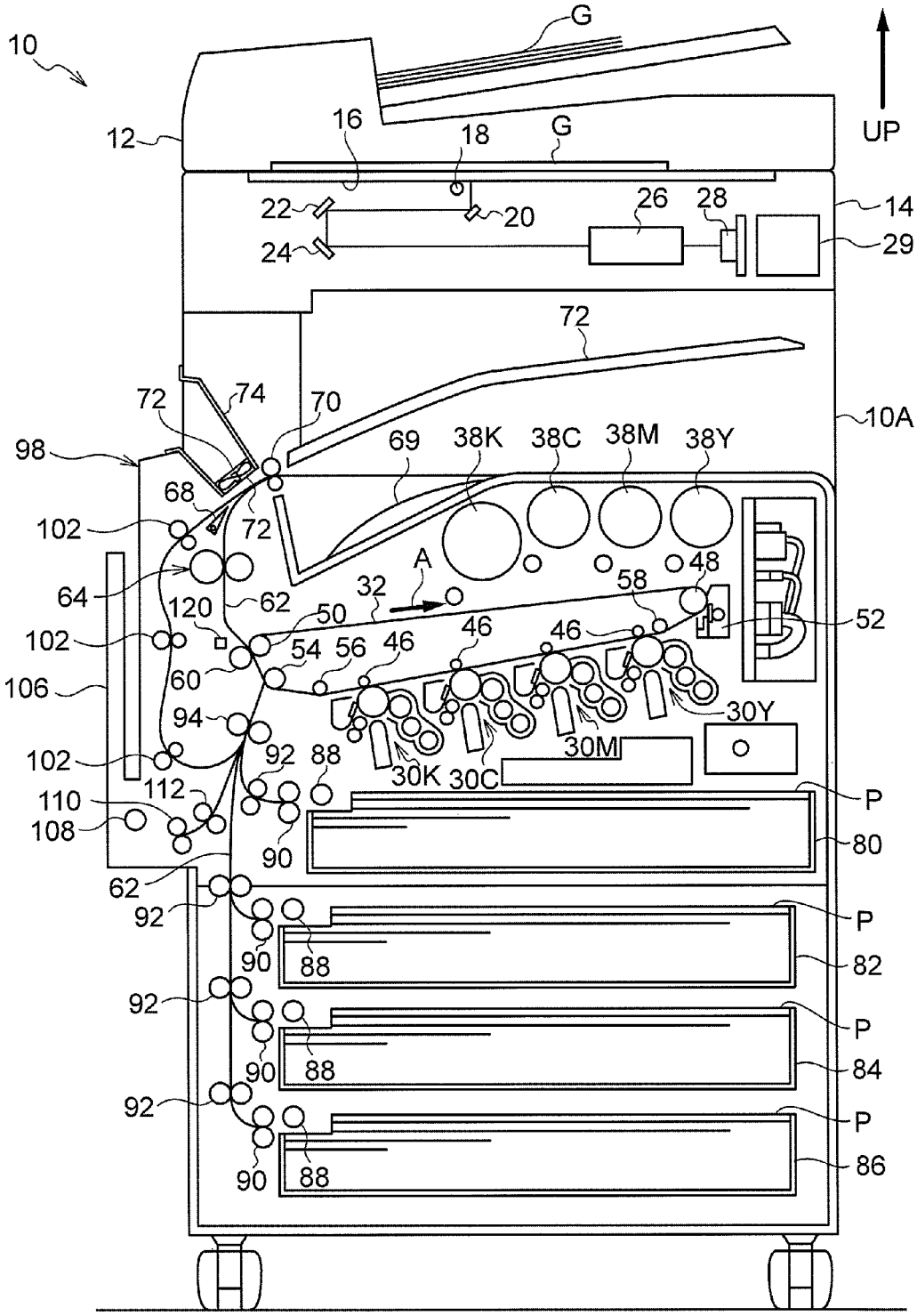
FIG. 5 is a general configuration diagram showing the image forming apparatus pertaining to the first exemplary embodiment of the present invention.

As shown in FIG. 5, the image forming apparatus 10 pertaining to the present exemplary embodiment has an apparatus body 10A. In the upper portion of the apparatus body 10A, there are disposed an automatic document feeder 12 that automatically feeds multiple reading documents G one at a time, a platen glass 16 on which one reading document G is placed, and a document reader 14 that reads the reading documents G that have been fed by the automatic document feeder 12 or the reading document G that has been placed on the platen glass 16.

In this document reader 14, there is disposed a light source 18 that irradiates the reading documents G that have been fed by the automatic document feeder 12 or the reading document G that has been placed on the platen glass 16 with light.

Moreover, in the document reader 14, there is disposed an optical system configured from a full-rate mirror 20 that causes reflection light that has been emitted by the light source 18 and reflected from the reading documents G to be reflected in a direction parallel to the platen glass 16, a half-rate mirror 22 that causes the reflection light that has been reflected by the full-rate mirror 20 to be reflected downward, a half-rate mirror 24 that causes the reflection light that has been reflected by the half-rate mirror 22 to be reflected back in a direction parallel to the platen glass 16, and an imaging lens 26 on which the reflection light that has been reflected back by the half-rate mirror 24 is made incident.

Further, in the document reader 14, there is disposed a photoelectric conversion element 28 that converts the reflection light that has been imaged by the imaging lens 26 into electrical signals, and there is also disposed an image processor 29 that image-processes the electrical signals that have been converted by the photoelectric conversion element 28.

Additionally, the light source 18, the full-rate mirror 20, the half-rate mirror 22, and the half-rate mirror 24 are configured to be movable along the platen glass 16. When the reading document G that has been placed on the platen glass 16 is to be read, the light source 18 irradiates the reading document G that has been placed on the platen glass 16 with light while the light source 18, the full-rate mirror 20, the half-rate mirror 22, and the half-rate mirror 24 are moved, and the reflection light that has been reflected from the reading document G is imaged on the photoelectric conversion element 28.

Further, when the reading documents G that have been fed by the automatic document feeder 12 are to be read, the light source 18, the full-rate mirror 20, the half-rate mirror 22, and the half-rate mirror 24 stop in a determined position, the light source 18 irradiates the reading documents G that have been fed by the automatic document feeder 12 with light, and the reflection light that has been reflected from the reading documents G is imaged on the photoelectric conversion element 28.

In the vertical direction central portion of the apparatus body 10A, there are disposed multiple image forming units 30 that form toner images of mutually different colors and are arranged in a state where they are slanted with respect to the horizontal direction. Moreover, on the upper side of the image forming units 30, there is disposed an endless intermediate transfer belt 32 onto which the toner images that have been formed by the image forming units 30 of each color are transferred while the intermediate transfer belt 32 is driven around in the direction of arrow A in the drawings.

Figure 4:
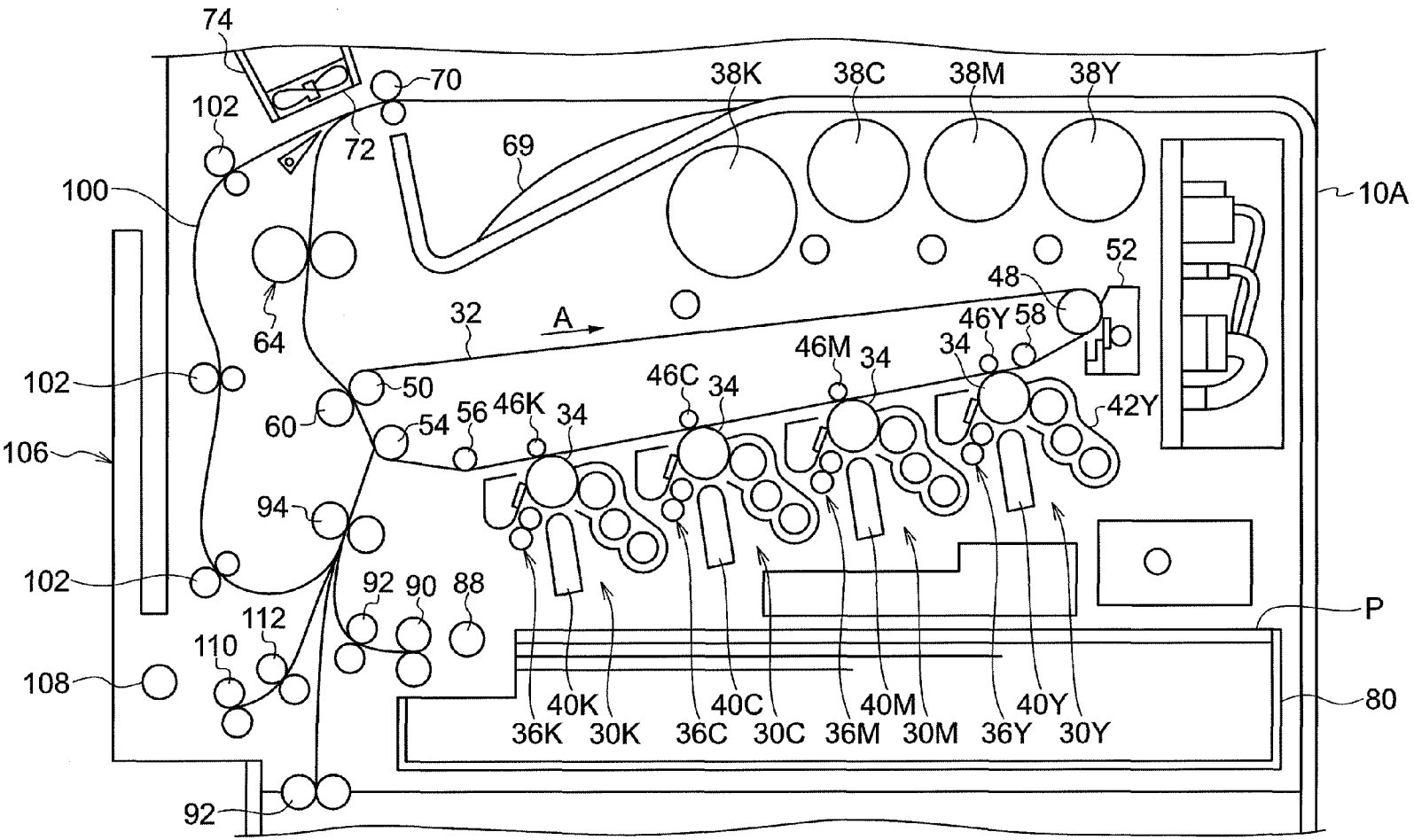
FIG. 4 is a side view showing the image forming units and an intermediate transfer belt and the like employed in the image forming apparatus pertaining to the first exemplary embodiment of the present invention.

Specifically, as shown in FIG. 4, four image forming units 30Y, 30M, 30C, and 30K of yellow (Y), magenta (M), cyan (C), and black (K) are disposed in this order. Additionally, the image forming unit 30Y, in which the yellow (Y) toner image that is transferred first onto the intermediate transfer belt 32 is formed, is disposed in the highest position. The image forming unit 30K, in which the black (K) toner image that is transferred last onto the intermediate transfer belt 32 is formed, is disposed in the lowest position. Overall, the image forming units 30Y, 30M, 30C, and 30K are arranged a certain interval apart from each other in a state where they are diagonally slanted a predetermined angle with respect to the horizontal direction.

These four image forming units 30Y, 30M, 30C, and 30K are basically configured in the same manner. In the description below, the letters (Y, M, C, and K) corresponding to each color will be added to the reference numerals when distinguishing between the colors and the letters corresponding to each color will be omitted when not distinguishing between the colors.

Figure 3:
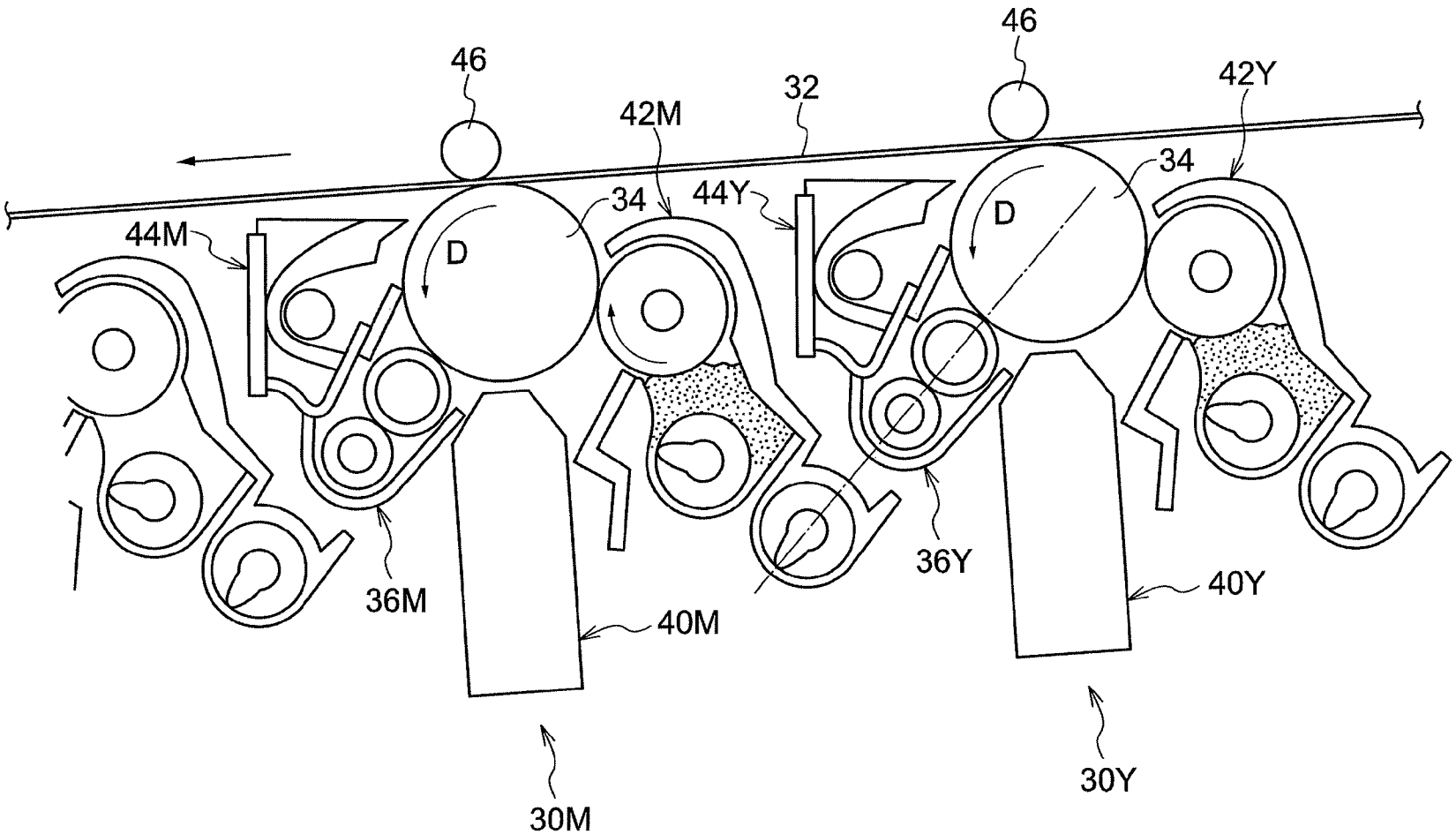
FIG. 3 is a side view showing image forming units employed in the image forming apparatus pertaining to the first exemplary embodiment of the present invention.

As shown in FIG. 3, in the image forming units 30 of each color, there is disposed an image holder (an image bearing body) 34 that is rotated in the direction of arrow D by unillustrated driving means, and there is also disposed a charging-use charging member 36 that uniformly charges the surface of this image holder 34.

Further, on the downstream side of the charging member 36 in the direction of rotation of the image holder 34, there is disposed an exposure device 40 that exposes the surface of the image holder 34 that has been uniformly charged by the charging member 36 to light corresponding to a predetermined color to thereby form an electrostatic latent image on the surface of the image holder 34. Moreover, on the downstream side of the exposure device 40 in the direction of rotation of the image holder 34, there is disposed a developing device 42 that develops, with a toner of a predetermined color, the electrostatic latent image that has been formed on the surface of the image holder 34 to thereby make the electrostatic latent image visible as a toner image.

On the opposite side of the image holder 34 across the intermediate transfer belt 32, there is disposed a primary transfer member 46 for transferring the toner image that has been formed on the surface of the image holder 34 onto the intermediate transfer belt 32. Moreover, a cleaning device 44, which cleans residual toner and the like that remains on the surface of the image holder 34 without being transferred from the image holder 34 to the intermediate transfer belt 32, is disposed touching the surface of the image holder 34 on the downstream side of the primary transfer member 46 in the direction of rotation of the image holder 34.

In other words, each of the image forming units 30 is configured to include the image holder 34, the charging member 36, the exposure device 40, the developing device 42, and the cleaning device 44.

Above the intermediate transfer belt 32, there are disposed toner cartridges 38Y, 38M, 38C, and 38K (see FIG. 5) that supply the toners of the predetermined colors to the developing devices 42 of each color of yellow (Y), magenta (M), cyan (C), and black (K). Additionally, the toner cartridge 38K that houses the black (K) color toner is configured to be larger in size as compared to the toner cartridges of the other colors because it is frequently used.

According to this configuration, toner images are formed as described below.

As shown in FIG. 4 and FIG. 5, image data of each color are sequentially outputted from the image processor 29 or from the outside to the exposure devices 40Y, 40M, 40C, and 40K individually disposed in the image forming units 30Y, 30M, 30C, and 30K of each color of yellow (Y), magenta (M), cyan (C), and black (K). Moreover, the light that has been emitted from these exposure devices 40Y, 40M, 40C, and 40K in response to the image data exposes the surfaces of the corresponding image holders 34, and electrostatic latent images are formed on the surfaces of the image holders 34. The electrostatic latent images that have been formed on the surfaces of the image holders 34 are developed as toner images of each color of yellow (Y), magenta (M), cyan (C), and black (K) by the developing devices 42Y, 42M, 42C, and 42K.

Moreover, the toner images of each color of yellow (Y), magenta (M), cyan (C), and black (K) that have been sequentially formed on the surfaces of the image holders 34 are multiply transferred by the primary transfer members 46 onto the intermediate transfer belt 32, which is placed slanted above the image forming units 30Y, 30M, 30C, and 30K of each color.

As shown in FIG. 4, this intermediate transfer belt 32 is wrapped with a certain tension around a drive roll 48 that applies a driving force to the intermediate transfer belt 32, a support roll 50 that passively rotates, a tension applying roll 54 that applies tension to the intermediate transfer belt 32, a first idler roll 56, and a second idler roll 58.

Moreover, a cleaning device 52 that cleans the surface of the intermediate transfer belt 32 is disposed on the opposite side of the drive roll 48 across the intermediate transfer belt 32. This cleaning device 52 is configured such that it may be freely attached to and detached from the apparatus body 10A by opening a front cover (not shown) disposed on the front side (the side in front of which a user stands) of the apparatus body 10A.

Moreover, on the opposite side of the support roll 50 across the intermediate transfer belt 32, there is placed a secondary transfer member 60 for secondarily transferring to a sheet member P serving as a recording medium, the toner images that have been primarily transferred onto the intermediate transfer belt 32. In other words, the position between the secondary transfer member 60 and the support roll 50 is configured to be a secondary transfer position where the toner images are transferred to the sheet member P.

As shown in FIG. 5, above the secondary transfer roll 60, there is disposed a fixing device (heating device) 64 that applies heat and pressure to the toner images to thereby fix the toner images to the sheet member P to which those toner images have been transferred by the secondary transfer member 60 and which is conveyed along a conveyance path 62.

Moreover, on the downstream side of the fixing device 64 in the conveyance direction of the sheet member P (hereinafter simply called "the conveyance direction downstream side"), there is disposed a guide gate 68 serving as one example of a guide member that guides the sheet member P.

Further, on the conveyance direction downstream side of the guide gate 68, there are disposed ejection rolls 70 serving as one example of an ejection member that ejects the sheet member P guided by the guide gate 68 into an output bin 69.

Moreover, above the guide gate 68, there is disposed a blower fan 72 serving as one example of a blower member that blows air onto the sheet member P conveyed between the guide gate 68 and the ejection rolls 70. The details of the blower fan 72 will be described later.

In the lower portion of the apparatus body 10A and on the upstream side of the secondary transfer member 60 in the conveyance direction of the sheet member P (hereinafter simply called "the conveyance direction upstream side), there are disposed input trays 80, 82, 84, and 86 in which the sheet members P are housed. Sheet members P of different sizes are housed in each of the input trays 80, 82, 84, and 86.

Moreover, in each of the input trays 80, 82, 84, and 86, there are disposed feed rolls 88 that feed the housed sheet members P from each of the input trays 80, 82, 84, and 86 to the conveyance path 62. On the conveyance direction downstream side of the feed rolls 88, there are disposed conveyance rolls 90 and conveyance rolls 92 that convey the sheet members P one at a time.

Further, on the conveyance direction downstream side of the conveyance rolls 92, there are disposed registration rolls 94 that temporarily stop the sheet member P and feed the sheet member P to the secondary transfer position at a predetermined timing.

In order to allow an image to be formed on both sides of the sheet member P, a two-side conveyance unit 98 that inverts and conveys the sheet member P is disposed on the side of the secondary transfer position. Additionally, in the two-side conveyance unit 98, there is disposed an inversion path 100 to which the sheet member P guided by the guide gate 68 is fed by as a result of the ejection rolls 70 being reversely rotated after the trailing end of the sheet member P has passed the guide gate 68. Moreover, multiple conveyance rolls 102 are disposed along the conveyance path 100, and the sheet member P conveyed by these conveyance rolls 102 is again conveyed to the registration rolls 94 in a state where its front and back sides have been inverted.

Further, adjacent to the two-side conveyance unit 98, there is disposed a foldaway manual input tray 106. Additionally, there are disposed a feed roll 108 and conveyance rolls 110 and 112 that convey the sheet member P fed from the opened foldaway manual input tray 106. The sheet member P that has been conveyed by the conveyance rolls 110 and 112 is conveyed to the registration rolls 94.

(Configurations of Relevant Portions)

Next, the blower fan 72 and the like will be described.

As shown in FIG. 1, the blower fan 72 is placed above the guide gate 68 so as to blow air onto the sheet member P conveyed between the guide gate 68 and the ejection rolls 70. Additionally, one end of the blower fan 72 is fixed to the other end of an intake duct 74 fixed to the side wall of the apparatus body 10A. By activating the blower fan 72, outside air that has been taken in through the intake duct 74 is blown onto the conveyed sheet member P. The blower fan 72 may be an axial fan or a centrifugal fan.

Further, on the opposite side of the intake duct 74 across the conveyance path 62, there is disposed an outlet duct 76 that lets out, toward the sheet member P that has been ejected into the output bin 69, the air generated by the blower fan 72 after the sheet member P has passed the position opposing the blower fan 72. Specifically, the end portion of the outlet duct 76 is attached to a vertical wall 82 configuring the output bin 69. Moreover, slits 82A that allow the air that has been let out by the outlet duct 76 to pass therethrough are formed in the vertical wall 82, and the air is blown through these slits 82A onto the sheet member P that has been ejected into the output bin 69.

Moreover, a controller 84 that controls the operation of the blower fan 72 is disposed. This controller 84 is configured to activate the blower fan 72 when the recording page count of one or more print jobs in which toner images are continuously formed on both recording sides of each of the sheet members P and in which at least one side of each of those sheet members P undergoes color printing is equal to or greater than a predetermined recording page count (in the present exemplary embodiment, 100 pages as one example) and the ambient temperature when electrical power has been supplied to the apparatus is equal to or greater than a predetermined temperature (in the present exemplary embodiment, 25° C. as one example).

A temperature sensor 120 that detects the ambient temperature in the neighborhood of the secondary transfer member 60 (see FIG. 4) is disposed, and the ambient temperature when electrical power has been supplied to the apparatus (at the time of startup) is detected by this temperature sensor 120.

Further, in counting the aforementioned predetermined recording page count (in the present exemplary embodiment, 100 pages as one example), when there are multiple print jobs, then printing is regarded as being continuous when the amount of time between the time when a previous print job ends and the time when a subsequent print job starts is within 10 minutes.

Further, when electrical power has been supplied to the image forming apparatus 10 again after electrical power has not been supplied to the image forming apparatus 10 for a certain amount of time (in the present exemplary embodiment, 1 hour) or more, the ambient temperature that has been measured by the temperature sensor 120 when electrical power has been supplied again is regarded as the ambient temperature when electrical power has been supplied to the apparatus. In contrast, when the amount of time in which electrical power has not been supplied to the image forming apparatus 10 is less than 1 hour, the ambient temperature that has been measured by the temperature sensor 120 at the time of previous electrical power supply, and not the ambient temperature when electrical power has been supplied again, is regarded as the ambient temperature when electrical power has been supplied to the apparatus.

Figure 2A:
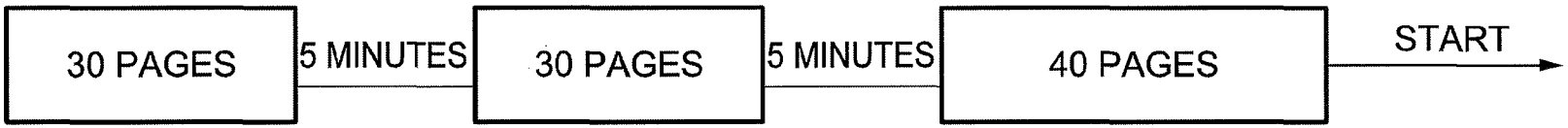
FIGS. 2A and 2B are explanatory diagrams describing timings when the blower fan employed in the image forming apparatus pertaining to the first exemplary embodiment of the present invention is activated.

For example, as shown in FIG. 2A, when the temperature that has been detected by the temperature sensor 120 when electrical power has been supplied to the image forming apparatus 10 is equal to or greater than 25° C. and two-sided (duplex) printing (where at least one side undergoes color printing) print jobs have been executed at 5-minute intervals in the order of a first print job having 30 pages (15 sheets), a second job having 30 pages (15 sheets), and a third job having 40 pages (20 sheets), the controller 84 activates the blower fan 72 at the point in time when the recording page count has reached a total of 100 pages.

Figure 2B:
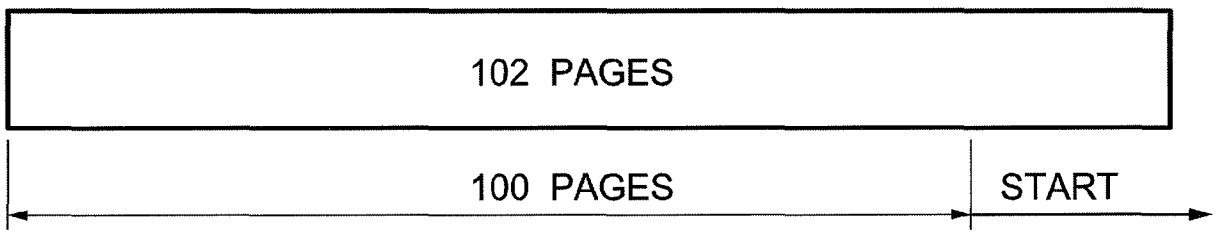

Further, as shown in FIG. 2B, when the temperature that has been detected by the temperature sensor 120 when electrical power has been supplied to the image forming apparatus 10 is equal to or greater than 25° C. and a two-sided printing (where at least one side undergoes color printing) print job having 120 pages (60 sheets) has been executed, the controller 84 activates the blower fan 72 at the point in time when the page count has reached a total of 100 pages.

In other words, in the case of continuous printing where the recording page count is equal to or greater than the predetermined recording page count, the continuous operating time becomes longer, so the temperature inside the apparatus body 10A rises and it becomes difficult for the toner images that have been formed on the sheet members P to cool. Further, in the case of color printing, toner images of several colors are formed on single sheets of the sheet members P, so it becomes difficult for the toner images that have been formed on the sheet members P to cool because the toner consumption amount (area coverage) per sheet becomes larger and the fixing heat amount is also large.

Further, in two-sided printing, toner images are formed on both recording sides, so it is easy for the temperature to become higher because the sheet members P are heated twice and it becomes difficult for the toner images that have been formed on the sheet members P to cool. Further, when the temperature that has been detected by the temperature sensor 120 when electrical power has been supplied is higher than the predetermined temperature, it becomes difficult for the toner images that have been formed on the sheet members P to cool.

In this manner, the controller 84 is configured to activate the blower fan 72 only when there are conditions where it is difficult for the toner images that have been formed on the sheet members P to cool and there is the potential for the sheet members P that have been ejected into the output bin 69 to stick to each other.

(Action)

Next, the action of the blower fan 72 and the like will be described.

When the temperature that has been detected by the temperature sensor 120 when electrical power has been supplied to the image forming apparatus 10 is equal to or greater than 25° C. and one or more two-sided printing (where at least one side undergoes color printing) print jobs equal to or greater than 100 pages are executed, toner images are sequentially formed on both sides of the sheet members P.

As shown in FIG. 1, after the sheet member P on which the toner image corresponding to the $100^{th}$ page has been formed is subjected to heat and pressure by the fixing device 64 and the toner image that has been formed on the sheet member P is fixed to the sheet member P, the sheet member P is conveyed toward the ejection rolls 70.

The controller 84 activates the blower fan 72 such that the blower fan 72 blows air onto the sheet member P on which the toner image corresponding to the $100^{th}$ page has been formed. Additionally, the blower fan 72 blows air (outside air) onto the sheet member P on which the toner image corresponding to the $100^{th}$ page has been formed and which is conveyed between the guide gate 68 and the ejection rolls 70.

After the toner image that has been fixed to the sheet member P is cooled as a result of air being blown onto the sheet member P (twice cooled because it is two-sided), the sheet member P is ejected into the output bin 69 by the ejection rolls 70.

As described above, the sheet member P is ejected into the output bin 69 after the toner image that has been fixed to the sheet member P is cooled, so a situation where the sheet members P are placed on top of each other in a state where the toner images are not completely cooled such that the sheet members P stick to each other is controlled.

Further, the controller 84 activates the blower fan 72 only when there are conditions where it is difficult for the toner images that have been formed on the sheet members P to cool and there is the potential for the sheet members P that have been ejected into the output bin 69 to stick to each other, so the operating time of the blower fan 72 is shortened.

Further, the controller 84 activates the blower fan 72 only when there are conditions where it is difficult for the toner images that have been formed on the sheet members P to cool and there is the potential for the sheet members P that have been ejected into the output bin 69 to stick to each other, so noise generated by the operation of the blower fan 72 is reduced.

Further, the controller 84 activates the blower fan 72 only when there are conditions where it is difficult for the toner images that have been formed on the sheet members P to cool and there is the potential for the sheet members P that have been ejected into the output bin 69 to stick to each other, so the amount of electrical power consumed by the operation of the blower fan 72 is reduced.

Further, when there is no sheet member P in the conveyance path 62 opposing the blower fan 72, the air that has been let out by the outlet duct 76 passes through the slits 82A and is blown onto the sheet members P that have been placed on top of each other in the output bin 69, so the sheet members P that have been placed on top of each other are effectively cooled.

The present invention has been described in detail in regard to a particular exemplary embodiment, but the present invention is not limited to this exemplary embodiment, and it will be apparent to practitioners skilled in the art that various other embodiments are possible in the scope of the present invention. For example, in the preceding exemplary embodiment, air is blown onto the recording side on the opposite side of the recording side on which a toner image has been formed, but air may also be blown directly onto the recording side on which a toner image has been formed.

Next, an image forming apparatus pertaining to a second exemplary embodiment of the present invention will be described in regard to FIGS. 6A and 6B. Regarding members that are the same as those in the first exemplary embodiment, the same reference signs will be given thereto and description thereof will be omitted.

In the second exemplary embodiment, in contrast to the first exemplary embodiment, the controller is not configured to activate the blower fan at the point in time when the recording page count has reached the total of 100 pages but rather is configured to activate the blower fan at the beginning of a print job determined to lead to continuous printing where the recording page count will become equal to or greater than the total of 100 pages.

Figure 6A:
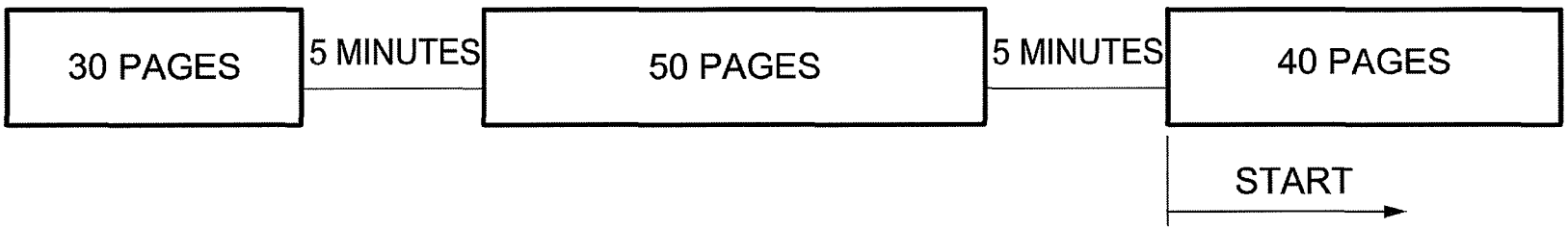
FIGS. 6A and 6B are explanatory diagrams describing timings when the blower fan employed in the image forming apparatus pertaining to a second exemplary embodiment of the present invention is activated.

Specifically, as shown in FIG. 6A, when the temperature that has been detected by the temperature sensor 120 when electrical power has been supplied to the image forming apparatus is equal to or greater than 25° C. and two-sided printing (where at least one side undergoes color printing) print jobs have been executed at 5-minute intervals in the order of a first print job having 30 pages (15 sheets), a second print job having 50 pages (25 sheets), and a third print job having 40 pages (20 sheets), the controller 84 activates the blower fan 72 at the point in time when the third job (the 40-page job) determined to lead to the total of 100 pages starts.

Figure 6B:
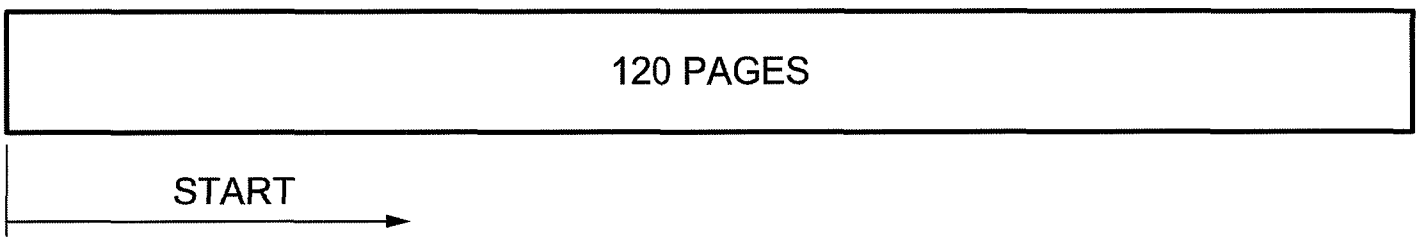

Further, as shown in FIG. 6B, when the temperature that has been detected by the temperature sensor 120 when electrical power has been supplied to the image forming apparatus is equal to or greater than 25° C. and a two-sided printing (where at least one side undergoes color printing) print job having 120 pages (60 sheets) has been executed, the controller 84 activates the blower fan 72 at the point in time when that print job starts because that print job has been determined to lead to the total of 100 pages.

As described above, the toner images that have been formed on the sheet members P are cooled early as a result of the controller activating the blower fan, so a situation where the sheet members P that have been placed on top of each other in the output bin stick to each other is effectively controlled.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a heating device that heats images that have been formed on a sheet-like recording medium to thereby fix the images to the recording medium;

an ejection member that rotates in a forward direction and ejects to the outside the recording medium that has been conveyed from the heating device;

a blower member that blows air onto the recording medium conveyed between the heating device and the ejection member; and a controller that controls the blower member such that the blower member operates when a recording page count where images are continuously formed on the recording medium is equal to or greater than a predetermined recording page count and the blower member is not activated when the recording page count, where images are continuously formed in the recording medium, is lower than a predetermined recording page count.

2. The image forming apparatus according to claim 1, further comprising an inversion path for inverting front and back sides of the recording medium after an image has been fixed to one recording side by the heating device to thereby allow an image to be formed on the other recording side, and a guide member that is disposed between the heating device and the ejection member on an upstream side of the blower member in a conveyance direction of the recording medium and which guides to the inversion path the recording medium that is conveyed as a result of the ejection member being rotated in a reverse direction before the recording medium is ejected to the outside, wherein the recording page count is a page count when images are formed on both recording sides and at least one side undergoes color printing.

3. The image forming apparatus according to claim 1, wherein the controller activates the blower member when the recording page count where images are continuously formed on the recording medium is equal to or greater than the predetermined recording page count and an ambient temperature when electrical power has been supplied to an apparatus body is equal to or greater than a predetermined temperature.

4. An image forming apparatus comprising:

a heating device that heats images that have been formed on a sheet-like recording medium to thereby fix the images to the recording medium;

an ejection member that rotates in a forward direction and ejects to the outside the recording medium that has been conveyed from the heating device;

a blower member that blows air onto the recording medium conveyed between the heating device and the ejection member; and a controller that controls the blower member such that the blower member operates when a recording page count where images are continuously formed on the recording medium is equal to or greater than a predetermined recording page count, wherein the recording page count is totaled in regard to a subsequent print job that is started within a certain amount of time after the end of a previous print job.

5. An image forming apparatus comprising:

a heating device that heats images that have been formed on a sheet-like recording medium to thereby fix the images to the recording medium;

an ejection member that rotates in a forward direction and ejects to the outside the recording medium that has been conveyed from the heating device;

a blower member that blows air onto the recording medium conveyed between the heating device and the ejection member; and a controller that controls the blower member such that the blower member operates when a recording page count where images are continuously formed on the recording medium is equal to or greater than a predetermined recording page count, wherein when it is anticipated that a recording page count of a print job that is to be executed will reach the predetermined recording page count, the controller controls the blower member so as to activate the blower member at the start of that print job.

6. An image forming apparatus comprising:

a heating device that heats images that have been formed on a sheet-like recording medium to thereby fix the images to the recording medium;

an ejection member that rotates in a forward direction and ejects to the outside the recording medium that has been conveyed from the heating device;

a blower member that blows air onto the recording medium conveyed between the heating device and the ejection member;

a controller that controls the blower member such that the blower member operates when a recording page count where images are continuously formed on the recording medium is equal to or greater than a predetermined recording page count; and an output bin that receives and holds the recording medium that has been ejected to the outside, wherein the blower member is configured such that, when there is no recording medium conveyed between the heating device and the ejection member, an airflow generated by the blower member reaches the top of the output bin.

* * * * *